US005605137A

United States Patent [19]

Priestly et al.

[11] Patent Number: 5,605,137

[45] Date of Patent: Feb. 25, 1997

[54] ENGINE FUEL CONTROL

[75] Inventors: John D. Priestly, Fenton; Michael J. Carman, Flint; Steven D. Thomson, Highland, all of Mich.

[73] Assignee: General Motors Corporation, Detroit, Mich.

[21] Appl. No.: 575,919

[22] Filed: Dec. 20, 1995

[51] Int. Cl.[6] ..... F02D 41/06

[52] U.S. Cl. ..... 123/491; 123/179.16

[58] Field of Search ..... 123/179.16, 491

[56] References Cited

U.S. PATENT DOCUMENTS

| | | | |
|---|---|---|---|
| 4,723,523 | 2/1988 | Kataoka et al. | 123/491 |
| 5,179,925 | 1/1993 | Orminski | 123/491 |
| 5,394,857 | 3/1995 | Yamakawa | 123/491 X |
| 5,469,827 | 11/1995 | Tomisawa | 123/491 |

*Primary Examiner*—Tony M. Argenbright
*Attorney, Agent, or Firm*—Michael J. Bridges

[57] ABSTRACT

Engine control responsive to temperature modeling error during an engine startup period following an engine latency period through time measurement of the latency period and modeling of the effects of the latency period length on a difference between a measured temperature parameter and the temperature of certain critical engine parts, such as engine cylinders, intake valves, fuel injectors etc. Compensation may be provided through variation of an engine fueling command during an engine startup period including during engine cranking as a function of temperature measurements and of the time length of the latency period. The compensation may decay gradually toward zero compensation as the modeling error decreases.

8 Claims, 6 Drawing Sheets

FIG−2

ENGINE FUEL CONTROL

FIELD OF THE INVENTION

This invention relates to automotive internal combustion engine control and, more particularly, to engine control responsive to engine temperature modeling during and following engine latency periods.

BACKGROUND OF THE INVENTION

Accurate automotive engine control requires accuracy in modeling the physical character of the engine, its components and parts under all engine operating conditions. Engine parameters such as temperature, pressure, mass, etc. are currently used to characterize the physical character of an engine. A substantial investment has been made in accurate sensing, estimating, or predicting of such engine parameters. Nonetheless, there remain engine operating conditions in which model errors persist, reducing engine control performance under such operating conditions. One example of such an operating condition is an engine startup condition following an engine latency period. It is common to preserve reserve electrical power, such as automotive vehicle battery power by disabling parameter sensors, estimators and predictors during engine latency periods. As such, variation in changing engine parameters, such as temperature parameters, is not logged during engine latency periods. Further, it is not economical or may not be technically feasible to measure every engine parameter of interest in engine control. Many engine parameters may be, under most operating conditions, accurately estimated using related measured engine parameter values. For example, under steady state engine operating conditions, engine cylinder temperature, engine intake valve temperature, and engine cylinder intake runner temperature may correspond well to measured engine coolant temperature. As such, most of the time during engine operation, a reasonable estimate of such temperatures is available simply by sensing coolant temperature. However, under engine startup conditions (which present many well-documented control stability, smoothness and efficiency challenges), the engine coolant temperature-based model of the temperature of such engine parts as intake runners, cylinders and intake valves, often is very inaccurate. The thermal time constant associated with the engine coolant system is significantly different than that of such other engine parts. Accordingly, such engine parts may heat up or cool down much more rapidly than engine coolant. For example, under a short run condition, when the engine has run a short time, is shut down for a short time and then is restarted, engine coolant may be at a low value, while certain engine parts may be fully elevated in temperature. A coolant temperature-based model will then be inaccurate.

The temperature of such engine parts as cylinders, intake valves intake runners, and fuel injector has a significant effect on the mixing and vaporization characteristic of an engine air/fuel mixture. Engine fueling control must account for the temperature of such parts to provide for accurate engine fueling, as is required for acceptable engine performance and emissions. Under engine startup conditions, such cannot be provided under conventional approaches relying on engine coolant temperature-based modeling.

It would therefore be desirable to accurately estimate the temperature of such engine parts following an engine latency period without incurring the cost and complexity associated with sensing temperature of every engine part or component to which the engine control is sensitive.

SUMMARY OF THE INVENTION

The present invention provides a desirable engine control including an accurate estimation and compensation for the temperature of such engine parts as cylinders, intake valves intake runners, and fuel injectors under operating conditions such as short run conditions when an engine coolant temperature-based temperature model may be inaccurate.

More specifically, the time length of an engine latency period is measured and engine control compensation is determined as a function of the time length. A measurement of an engine shutdown temperature at the beginning of the latency period, and of an engine startup temperature at the end of the latency period are provided. Accurate temperature modeling is then provided incorporating known thermal characteristics of the engine and engine parts and components using the shutdown and startup temperatures and the measured length of the engine latency period. The modeling may be provided in the form of a referenced control compensation factor applied directly in engine control. The compensation factor may gradually be decreased as the engine moves toward a steady state temperature operating condition in which the engine coolant temperature-based model accurately indicates the temperature of critical engine parts.

In accord with an aspect of this invention, the compensation factor may be provided as an engine fueling adjustment during an engine startup period in which coolant temperature modeling errors are likely to be present. A short run fuel control offset may be determined when a short run condition is present. The short run condition is present when the engine is shut down after a relatively short operating period so that engine coolant temperature lags significantly behind the temperature of certain engine parts or components. The short run offset may be determined as a function of the time length of the shutdown period to accurately model the change in engine fueling required to maintain accurate engine fuel control despite a temperature deviation between engine coolant and certain critical engine parts and components. The offset may be decayed toward zero over time as the temperature deviation decreases. The decay rate and the time that the decay is applied may vary as a function of the shut down period length.

In accord with yet a further aspect of this invention, a fueling adjustment may be determined as a function of the measured time length of the shut down period and may be applied during an engine cranking period prior to engine startup for accurate fueling control despite a significant temperature deviation between engine coolant and critical engine parts such as cylinders intake valves intake runners, and fuel injectors. Such a cranking fuel adjustment may only be applied when a short run condition is present. Engine control accuracy is achieved even in engine operating conditions in which the temperature of certain critical engine parts is significantly different than measured temperature parameters, such as measured engine coolant temperature.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
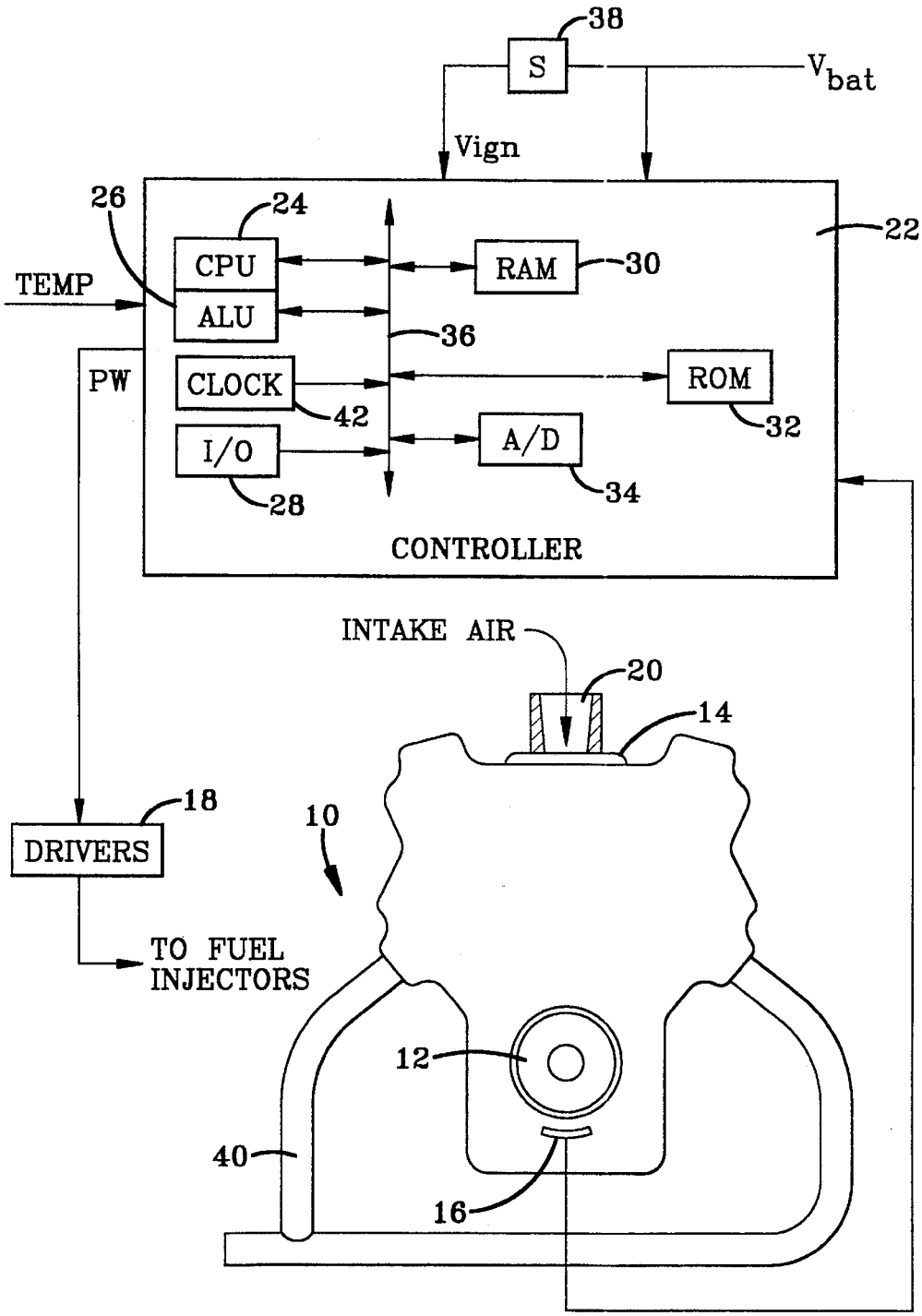
FIG. 1 is a general diagram of the engine and engine control hardware for carrying out this invention in accord with the preferred embodiment.

Referring to FIG. 1, internal combustion engine 10 receives intake air through intake air bore 20 to intake manifold 14 for distribution to engine cylinder intake air runners (or passages) and admission, upon occurrence of engine intake valve opening events, to engine cylinders (not shown). Electronically controlled fuel injectors (not shown) are disposed in the intake air runners (passages) for metering fuel thereto for mixing with the intake air to form an air/fuel mixture admitted upon occurrence of intake valve opening events to the engine cylinders for ignition therein.

The engine cylinder ignition reaction reciprocally drives cylinder pistons (not shown) disposed in the engine cylinders and mechanically linked to output shaft 12, such as a crankshaft, to rotate the output shaft. A plurality of spaced teeth or notches are disposed about a circumferential portion of the output shaft 12 in position to pass a conventional position sensor 16. The position sensor 16 may take the form of a well-known variable reluctance or Hall effect sensor transducing the passage of the teeth or notches into a sensor output signal voltage magnitude variation. While the engine is operating to rotate the engine output shaft 12, a periodic, sinusoidal waveform is therefore output by the sensor 16 having a frequency proportional to the rate of passage of the teeth by the sensor 16 and thus proportional to the rate of rotation of the output shaft 12. The teeth are positioned about the shaft circumference such that each passage of a tooth by the sensor corresponds to an engine cylinder event corresponding to a combustion event in a known engine cylinder. Additional teeth or notches may further be added for engine synchronization or diagnostic procedures.

Exhaust gasses produced in the engine cylinder combustion process are guided out of engine cylinders and through exhaust gas conduit 40. Engine coolant is circulated through a conventional circulation system (not shown) to provide for cooling of the engine 10 and parts and components thereof. A temperature sensor (not shown), such as a conventional thermistor or thermocouple is disposed in the coolant circulation system exposed to the circulating engine coolant for transducing the temperature thereof into output signal TEMP.

A controller 36, such as a conventional microcontroller includes such elements as a central processing unit CPU 40 with an arithmetic logic unit ALU 42, read only memory ROM devices 44, random access memory RAM devices 50, input/output control circuitry I/O 48, and analog to digital conversion circuitry A/D 46. The controller of this embodiment further includes a continuous-running 22 MHz frequency clock 42 with a 32 bit counter which is incremented at the clock frequency and the value of which counter is maintained by a continuous power supply applied to the controller 22, such as a battery voltage Vbat. The counter 42 includes an overflow bit which, if set, indicates a counter overflow condition wherein the counter value is automatically reset to zero and continues counting therefrom. The battery voltage Vbat is applied to a switched voltage source S 38 having output signal Vign which is applied to controller 22 for the duration of engine ignition cycles manually initiated and terminated by an engine operator.

An engine latency period is defined as the operating period between ignition cycles when conventional engine sensors and actuators are disabled, and when the controller is generally disabled, but when the clock 42 continues to run to maintain real time information. The difference in the clock counter value between the counter value at the time the engine operator removes Vign from the controller and the clock counter value at the time Vign is next applied to the controller indicates the time duration of the engine latency period, and is applied in accord with this invention to model temperature change in engine parts and components for use in a more accurate engine control, as will be further detailed in accord with this embodiment.

Returning to the controller 22 of FIG. 1, communication between the controller elements is provided through a series of data and address busses and control lines, generally illustrated as bus 52. The controller receives the sensor output signals, such as signals RPM and TEMP and, through execution of a series of operations, processes the input signals and generates control, diagnostic, and maintenance output signals for application to actuators, indicators, etc. in accord with general engine control, diagnostic and maintenance practices. For example, signal PW is repeatedly communicated by controller 22 to engine fuel injector drivers 18, such as in the form of conventional high current drivers for driving the engine fuel injectors to inject fuel to engine cylinders. The command PW may take the form of a fixed frequency, fixed amplitude, variable duty cycle pulse having a pulsewidth (or time duration) corresponding to an opening time of the next active fuel injector. During the opening time, pressurized fuel is allowed to pass through the injector, which operates as a binary valve in this embodiment, to the corresponding intake air runner.

The controller operations for carrying out such engine control, diagnostic, and maintenance functions may be stored in ROM 32 (FIG. 1) as a series of controller instructions automatically initiated by the controller following certain engine conditions or events. Other than the operations of FIGS. 2–5, such controller instructions may correspond to engine control, diagnostic, and maintenance operations generally known in the art and conventionally available. The controller operations for carrying out engine fuel control compensation in accord with the preferred embodiment of this invention are illustrated, in a step by step manner in FIGS. 2–5.

Figure 2:
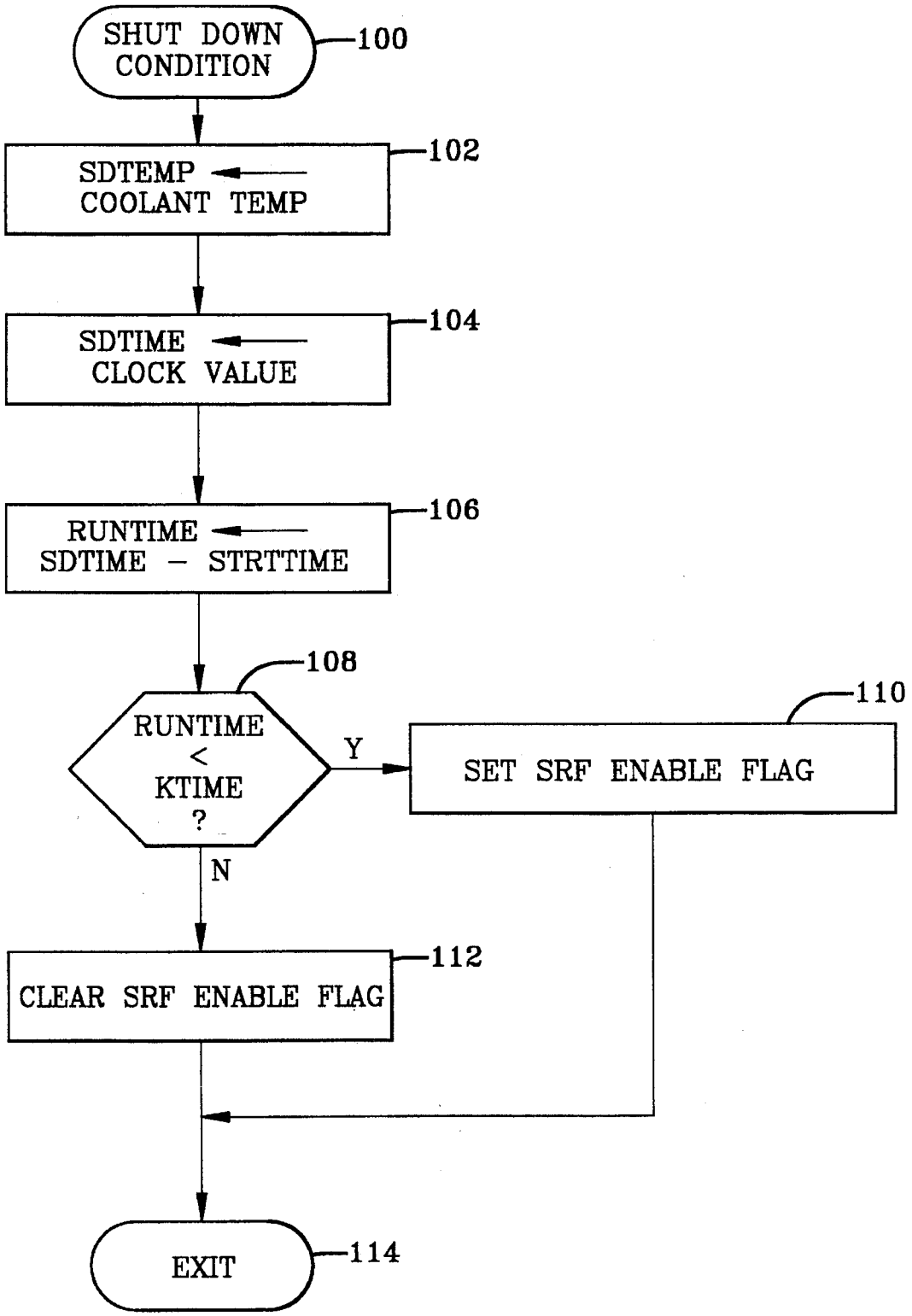
FIGS. 2–5 are computer flow diagrams illustrating a flow of operations for carrying out the preferred embodiment of this invention with the control hardware of FIG. 1.

More specifically, the operations of FIG. 2 are initiated at a step 100 when an engine operator manually acts to shut down the engine, such as by opening switch S 38 (FIG. 1) to provide for removal of ignition voltage Vign from the controller 22 (FIG. 1). The operations of FIG. 2 provide for a storing of critical control parameter information relating to the condition of the engine at the time of disabling of the engine 10. Following the step 100, the operations of FIG. 2 proceed to a next step 102 to store a current value of signal TEMP, representing engine coolant temperature at the time of the engine shut down, into a non-volatile memory location in RAM 30 (FIG. 1), with label SDTEMP. A current value of the described controller clock counter 42 is next stored into a non-volatile memory location in RAM 30 with label SDTIME, for starting a period of timing of the time length of the described engine latency period. A value RUNTIME, determined as a difference between the shutdown time SDTIME and a stored time value STRTTIME (to be described) is stored in a non-volatile memory location in RAM 30 (FIG. 1) with label RUNTIME, indicating the time length of the currently concluding engine ignition cycle.

The value RUNTIME is next compared, at a step 108, to a calibrated constant KTIME, representing the amount of engine run time following engine startup during which engine coolant temperature may not accurately reflect the temperature of such engine parts as engine cylinders, intake valves, intake runners, and fuel injectors due to the described engine coolant thermal lag. In this embodiment, KTIME is calibrated to a value of about 300 seconds. If RUNTIME is less than KTIME at the step 108, then a short run fueling (SRF) enable flag is set at a next step 110, providing for enabling of short run fueling compensation in accord with this embodiment. Short run fueling provides for a correction to an engine coolant temperature-based model during an engine startup control period, to correct for material elevation in temperature of such engine parts as engine cylinders, cylinder intake valves, and intake runners, and fuel injectors that is not provided for in the model, due to engine coolant thermal lag. If RUNTIME is not less than KTIME at the step 108, the SRF enable flag is cleared at the step 112 to indicate that short run fueling compensation is not currently required, as engine coolant temperature is substantially elevated to a level representative of the temperature of the described engine parts. Next, or following the described step 110, the routine is concluded at a step 114, so that other conventional engine control, diagnostic, or maintenance operations may be carried out.

Figure 3:
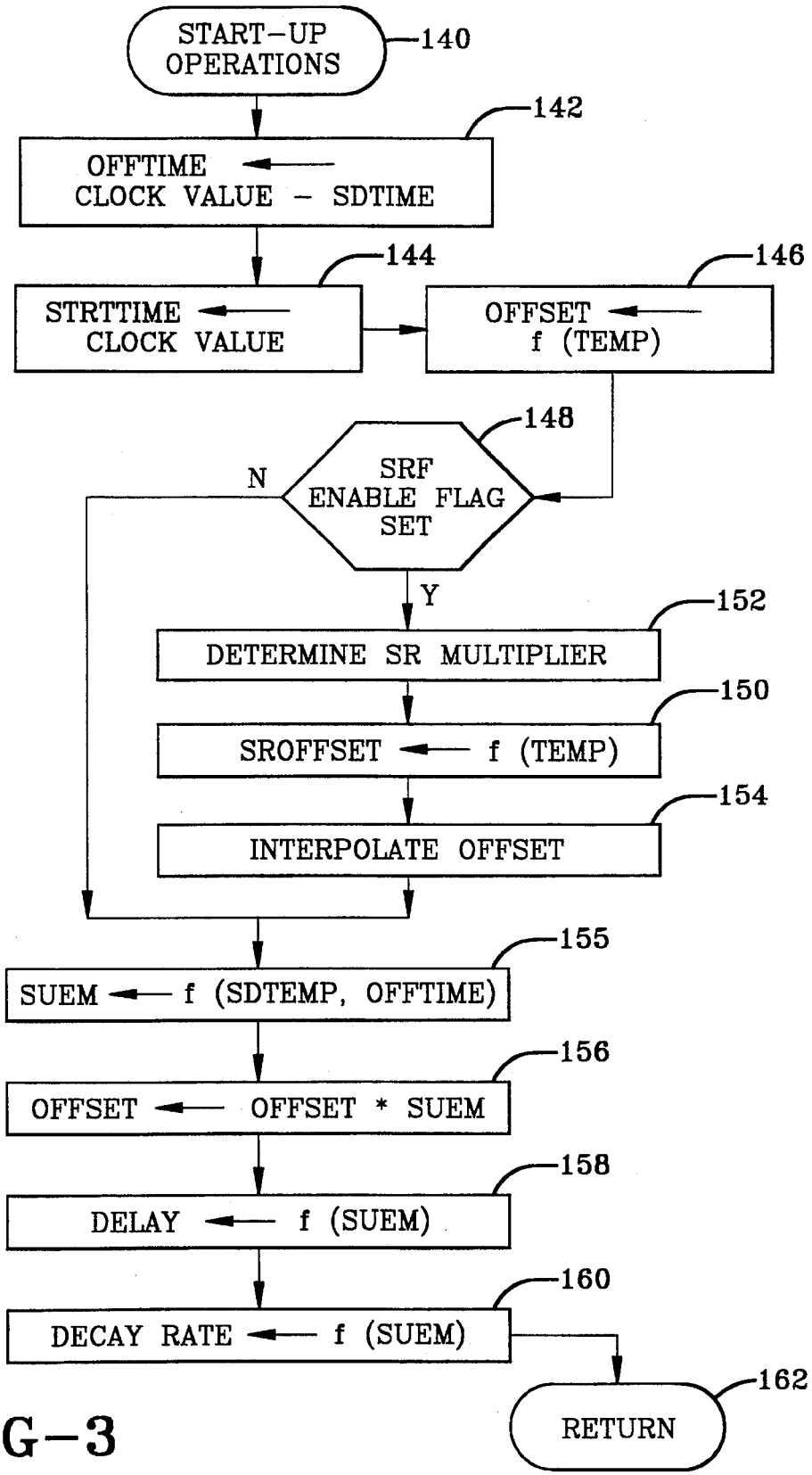

Referring to FIG. 3, a series of engine startup control operations including operations for determining engine fuel control compensation values for compensating engine coolant temperature-based model inaccuracy in accord with this invention during an engine startup period. Such startup control operations are carried out in a step by step manner starting at a step 140 upon manual application of Vign to the controller 22 thus terminating an engine latency period. Specifically, following the initial step 140, a stored value OFFTIME indicating the time length of the just-concluding engine latency period is calculated at a next step 142 as a difference between a current value of the counter of the controller clock 42 and the stored value SDTIME.

The current counter value of the controller clock 42 is next stored in RAM 30 with label STRTTIME, indicating the time of initiation of the current engine ignition cycle. A fuel control offset is next referenced at a step 146 from a stored offset schedule, determined through a conventional calibration process and stored in ROM 32 (FIG. 1), as a function of current engine coolant temperature indicated by signal TEMP. The stored offset schedule may reflect a conventional model of the variation in engine fueling required during an engine startup period as a function of coolant temperature. As described, such conventional model is inaccurate under certain engine operating conditions, such as short run conditions or hot restart conditions. Such offset inaccuracy is compensated in accord with this invention. After determining the offset, the SRF enable flag status is analyzed at a next step 148. If the SRF enable flag is set, short run fueling compensation is required as established through the described steps of the routine of FIG. 2, and is provided by proceeding to the steps 152–154.

Figure 7:
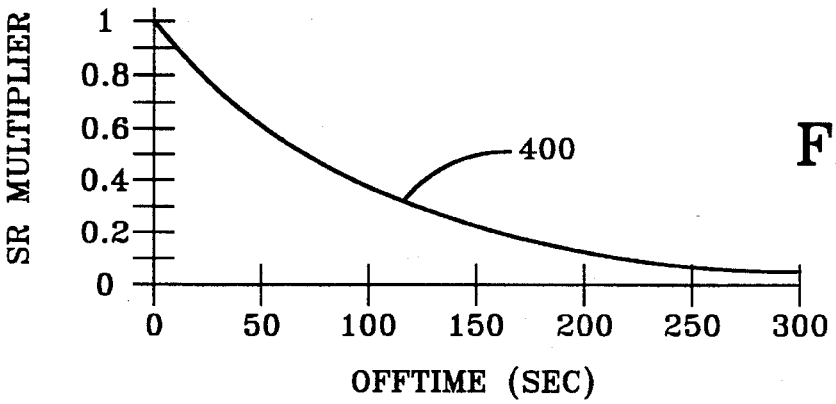

A short run multiplier is first referenced at a step 152 as a function of OFFTIME, for example as represented by curve 400 of FIG. 7. The short run multiplier represents the degree of short run fueling compensation required under current engine startup conditions. A short run multiplier value of unity indicates maximum short run fueling compensation and a multiplier of zero indicates minimum short run fueling compensation. The information of the curve 400 may be stored in the form of a conventional lookup table in ROM 32 (FIG. 1) as a function of OFFTIME, or may be stored as a function, and calculated at the step 152 as follows:

$$\text{SR Multiplier}=e^{-(offtime/K)}$$

in which K is a calibration constant set to about 100 seconds in this embodiment.

After determining the SR multiplier, a short run fueling offset SROFFSET is referenced at a next step 150 as a function of engine coolant temperature from a stored, calibrated schedule of engine fueling offsets. The short run offset schedule is established through a conventional calibration process as the maximum amount of fueling error caused by the described short run condition, for a given engine coolant temperature. After referencing SROFFSET, an offset interpolation process is carried out at a next step 152, weighted by the SR multiplier value, to incorporate short run compensation into the fueling offset in accord with the severity of the current short run condition, as follows:

$$\text{OFFSET} \leftarrow \text{OFFSET}-(\text{SRM}*(\text{OFFSET}-\text{SROFFSET}))$$

in which SRM is the SR multiplier. A maximum correction for short run conditions is thereby provided when SRM is unity corresponding to a minimum OFFTIME, with the degree of compensation decreasing toward zero compensation as OFFTIME increases, as described.

Figure 8:
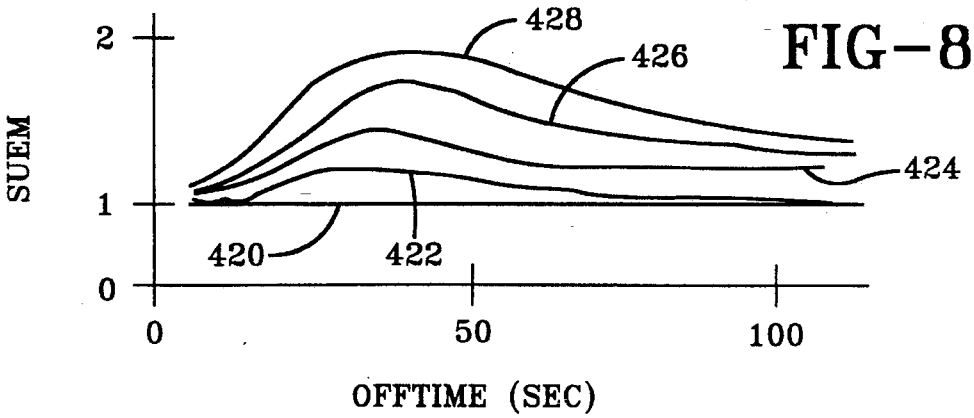

Next, or if the SRF enable flag is not set at the described step 148, a startup enrichment multiplier SUEM for modifying OFFSET is referenced at a step 155, for example from a calibrated, stored lookup table or a calibrated, stored mathematical function, as a function of SDTEMP and OFFTIME. Family of curves 420–428 of FIG. 8 illustrate such SUEM values for each of a plurality of SDTEMP values as a function of OFFTIME. For example, curve 420 represents SUEM values as a function of OFFTIME for SDTEMP values of about 110 degrees Celsius or less, curve 422 for SDTEMP values of about 115 degrees Celsius, curve 424 for SDTEMP values of about 120 degrees Celsius, curve 426 for SDTEMP values of about 125 degrees Celsius, and curve 428 for SDTEMP values of 130 degrees Celsius or more. The referenced SUEM value is applied to the current OFFSET at a next step 156 as a multiplicitive factor, to provide engine startup fueling enrichment.

A delay value and a decay rate are next determined at the steps 158 and 160, respectively, as functions of the determined SUEM value. The delay value is applied to delay a magnitude deterioration or decay of the determined offset in accord with a diminishing need for modification of engine coolant temperature-based fuel controls, and the decay rate corresponds to the rate of deterioration or decay of the delay value once the delay is concluded. Both such values are modified in accord with this invention, to correct for any modeling error in the conventional engine coolant temperature-based model of engine cylinder, intake runner, intake valve, and fuel injectors etc. temperature following an engine startup.

The delay value may be increased following an extended soak period of a hot engine in which the engine coolant temperature may underestimate the temperature of soaking engine parts. Again, such increase in the delay value may be calibrated as a function of the time length of the latency period and of the previous ignition cycle. Likewise, the decay rate may be adjusted in accord with modeling error of the conventional engine coolant temperature-based temperature model through a conventional calibration or experimentation process to adjust the rate at which the offset adjustment is reduced toward a zero adjustment. Following the determination of the delay and the decay rate at the steps 158 and 160, a step 162 is executed to return to normal engine startup control, diagnostic, and maintenance operations as may be generally understood in the art.

Figure 4:
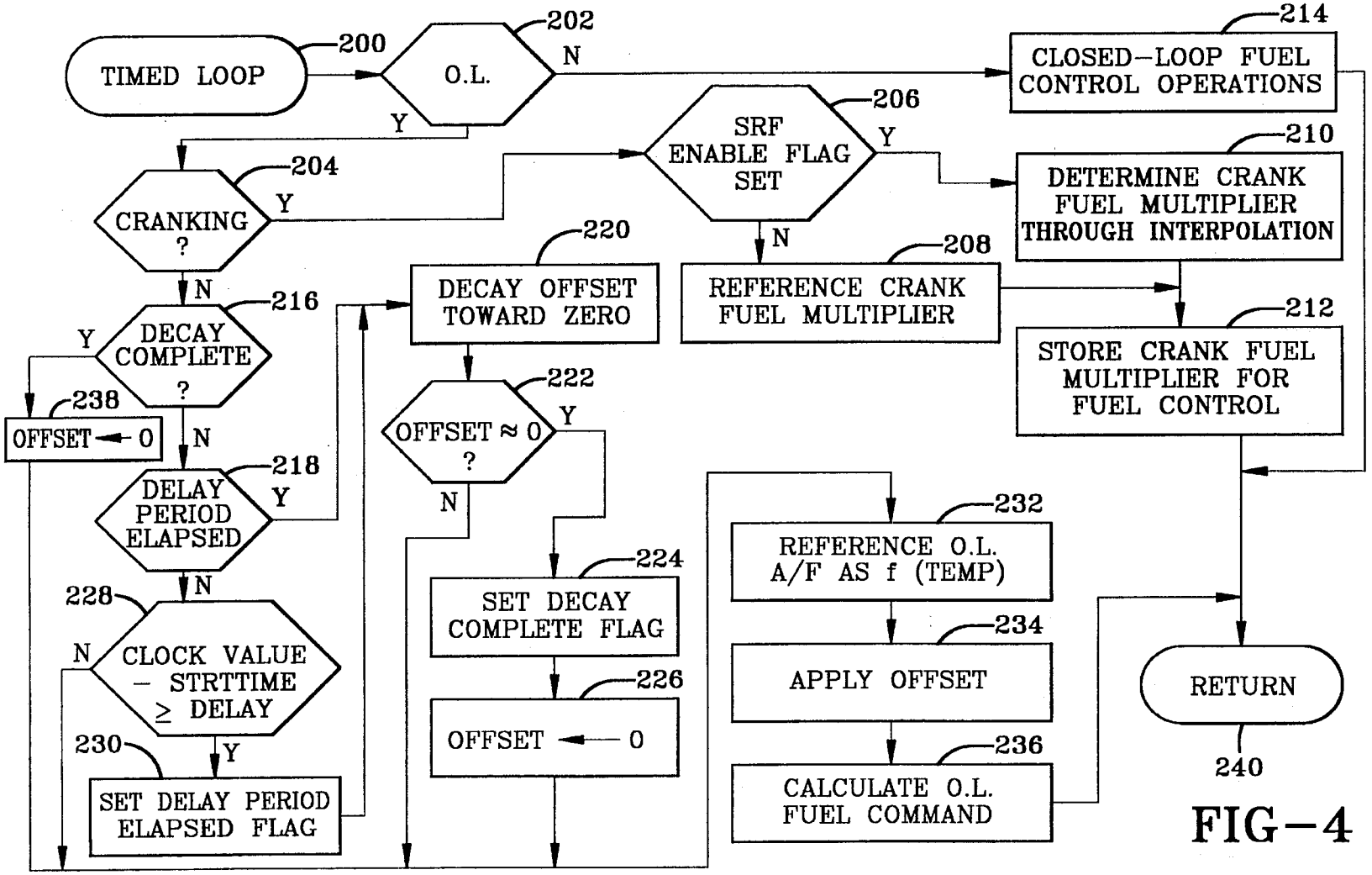

Referring to FIG. 4, a series of operations for periodically determining engine fueling command information in accord with this embodiment are illustrated in a step by step manner, for example stored as a series of controller instructions in ROM 32 (FIG. 1). These operations are initiated in this embodiment following a periodic timer event set up to occur at least every 12.5 milliseconds while ignition power Vign is applied to the controller 22 (FIG. 1). A timer interrupt is generated for each timer event and controller operations are temporarily suspended to service the interrupt by proceeding to the operations of FIG. 4, starting at a step 200 and proceeding to determine of open-loop engine control is currently active at a step 202. Open-loop engine control is characterized by open-loop estimation of engine control commands, such as engine intake air and fuel commands to achieve a desirable engine operating state during, for example, an engine startup period when the engine is not warmed up or following detection of an engine control fault condition. If the open-loop engine control is determined to not be active at the step 202, then closed-loop engine control operations, such as including closed-loop fuel control operations for generating a closed-loop fueling command in response to feedback signal information from an engine air/fuel ratio sensor (generally understood in the art) are carried out in any conventional manner at a next step 214, after which the operations of the routine of FIG. 4 are concluded by proceeding to a step 240 to return to resume the carrying out of any operations that were suspended to provide for the servicing of the timer interrupt via the described operations of FIG. 4.

Figure 6:
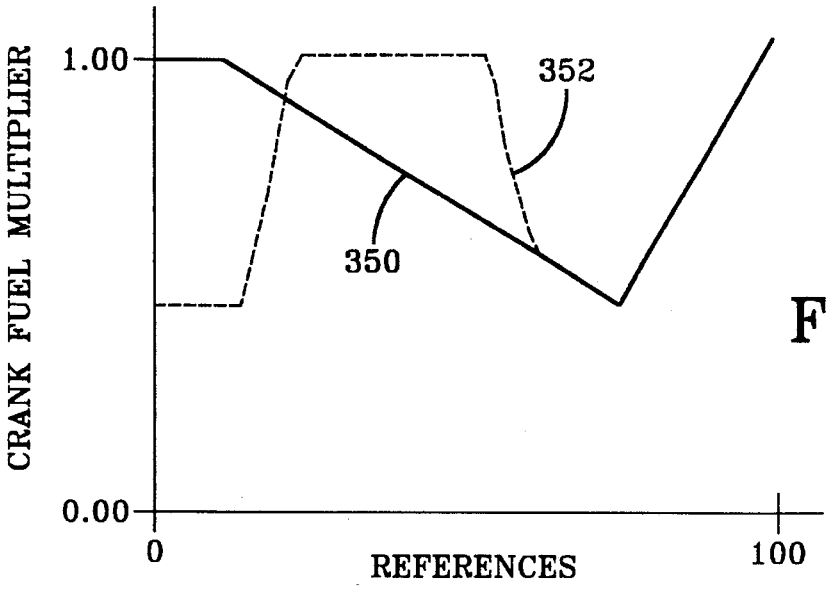
FIGS. 6–8 are graphical diagrams illustrating parameter relationships required for the carrying out of the operations of FIGS. 2–5.

Returning to step 202, if open-loop operations are active, a check is made at a step 204 of whether the engine is currently cranking, such as may be indicated by a very low engine speed RPM, for example a speed below 400 r.p.m. If the engine is determined to be cranking then engine fuel control operations for the cranking operating condition are next executed at the steps 206–212. First, the SRF enable flag is analyzed at a step 206. If such flag is set, then short run fueling compensation operations are active, and a crank fuel multiplier is determined through an interpolation process at a next step 210. This determination requires interpolation between a first and a second multiplier using the current SRM value. More specifically, a first multiplier CFM1 is referenced from a stored schedule of multipliers calibrated as a function of the number of engine cylinder events (references) since the beginning of the current ignition cycle. Curve 350 of FIG. 6 illustrates a representative calibration of CFM1 as a function of the number of references. The number of references corresponds, for example, to the number of revolutions of the engine crankshaft divided by N/2 in which N is the number of engine cylinders, for the four cycle engine of this embodiment. Likewise, a second multiplier CFM2 is referenced from a stored schedule of multipliers calibrated as a function of the number of engine cylinder events (references) since the beginning of the current ignition cycle. Curve 352 of FIG. 6 illustrates a representative calibration of CFM2 as a function of the number of references. The calibration of the schedule of CFM1 values may be carried out under normal startup conditions, for example under reasonably good correlation between engine coolant temperature and the temperature of engine parts and components. The calibration of the schedule of CFM2 values may be carried out during engine cranking under short run calibration conditions in which a significant engine coolant temperature model error may exist due to a prior engine short run in which engine parts but not engine coolant were significantly elevated in temperature, as described. The variation in multiplier values between CFM1 and CFM2, such as illustrated by the difference between curves 350 and 352 of FIG. 6, represents the calibrated variation in engine fueling required during cranking operations to account for inadequate fueling based on engine coolant temperature-based models. The calibrated schedules may be stored in the form of conventional lookup tables in controller ROM 32 (FIG. 1).

Returning to the step 210 of FIG. 4, after referencing CFM1 and CFM2, the overall crank fuel multiplier CFM is determined using the current SRM value as follows:

$$CFM=CFM1+SRM*(CFM2-CFM1),$$

providing for a standard linear interpolation between the two multipliers in accord with the magnitude of the SR multiplier (SRM) indicating the degree of potential model error caused by the specific short run condition for the most recent prior engine ignition cycle, as described. Returning to step 206, if the SRF enable flag is not set, a crank fuel multiplier CFM is referenced at a step 208 as CFM1, a function of the number of references or cylinder events since the start of the current engine ignition cycle using only the normal crank fuel multiplier schedule, for example from a stored lookup table in ROM 32, as described at the step 210 without interpolation modification using the short run table. The curve 350 of FIG. 6 illustrates a representative calibration relationship between the number of references and the multiplier magnitude referenced at the step 208. Next, or following the described step 210, the determined CFM is stored in RAM 30 (FIG. 1) as the current crank fuel multiplier. The described step 240 is then executed.

Returning to the step 204, if the engine is not currently cranking, engine startup fueling control operations are next executed as detailed in a step by step manner by the operations 216–236. An offset decay complete flag is first analyzed at a step 216 to determine whether it is set indicating a decay period of the offset is complete, to be described. If the decay is complete, the offset is maintained at zero at a next step 238, and a step 232, to be described is executed. If the decay is not complete as determined at the step 216, a delay period flag, stored in RAM 30 (FIG. 1) is next analyzed at a step 218 to determine if such flag is set indicating a delay period is complete. The delay period corresponds to a time period following startup of the engine (such as following engine cranking) in which the offset is applied with undiminished magnitude in fueling control, to be described, to provide for a determined engine startup fueling rate compensation. The delay is determined at the described step 158.

If the delay period flag is not set, a step 228 is executed to determine if the delay itself is complete. The delay is complete in this embodiment when the difference between the current clock value and the current STRTTIME value is greater than or equal to DELAY. If the delay is determined to be complete at the step 228, the delay period elapsed (complete) flag is set at a next step 230, and the magnitude of the offset is next decayed toward zero in accord with the determined decay rate at a next step 220, for example by applying the rate as a multiplier to the offset and then storing the product as the updated current offset value. If the decayed offset is substantially zero, such that no significant change in fueling will result from its application to a fueling command as determined at a next step 222, then a decay complete flag is set at a next step 224 and the offset is maintained at zero at a next step 226.

The step 232 is executed following the step 238, 226, if the delay period is not complete as determined at the step 228, and if the offset is not substantially zero as determined at the step 222. An open-loop (O.L.) desired cylinder air/fuel ratio is determined at the step 232 as a calibrated function of engine coolant temperature indicated by signal TEMP, for example from a conventional calibration schedule stored in the form of a lookup table in ROM 32 (FIG. 1), in accord with general startup engine control practices. The offset, determined through the operations of the routines of FIGS. 3 and 4, is next applied to adjust the open loop desired cylinder air/fuel ratio at a step 236, such as by subtracting the offset from the ratio. An open-loop fueling command is then calculated at a step 236 as a function of the adjusted desired air/fuel ratio and as a function of a measured or estimated cylinder intake air mass, for example as the required time of opening of the fuel injector to provide for delivery of a mass of fuel under pressure from a fuel supply (not shown) to a cylinder intake runner to mix with the intake air to form the adjusted desired open-loop cylinder air/fuel ratio. The fueling command is stored in RAM 30 (FIG. 1). The described step 240 is next executed to return and continue execution of any interrupted controller operations.

Figure 5:
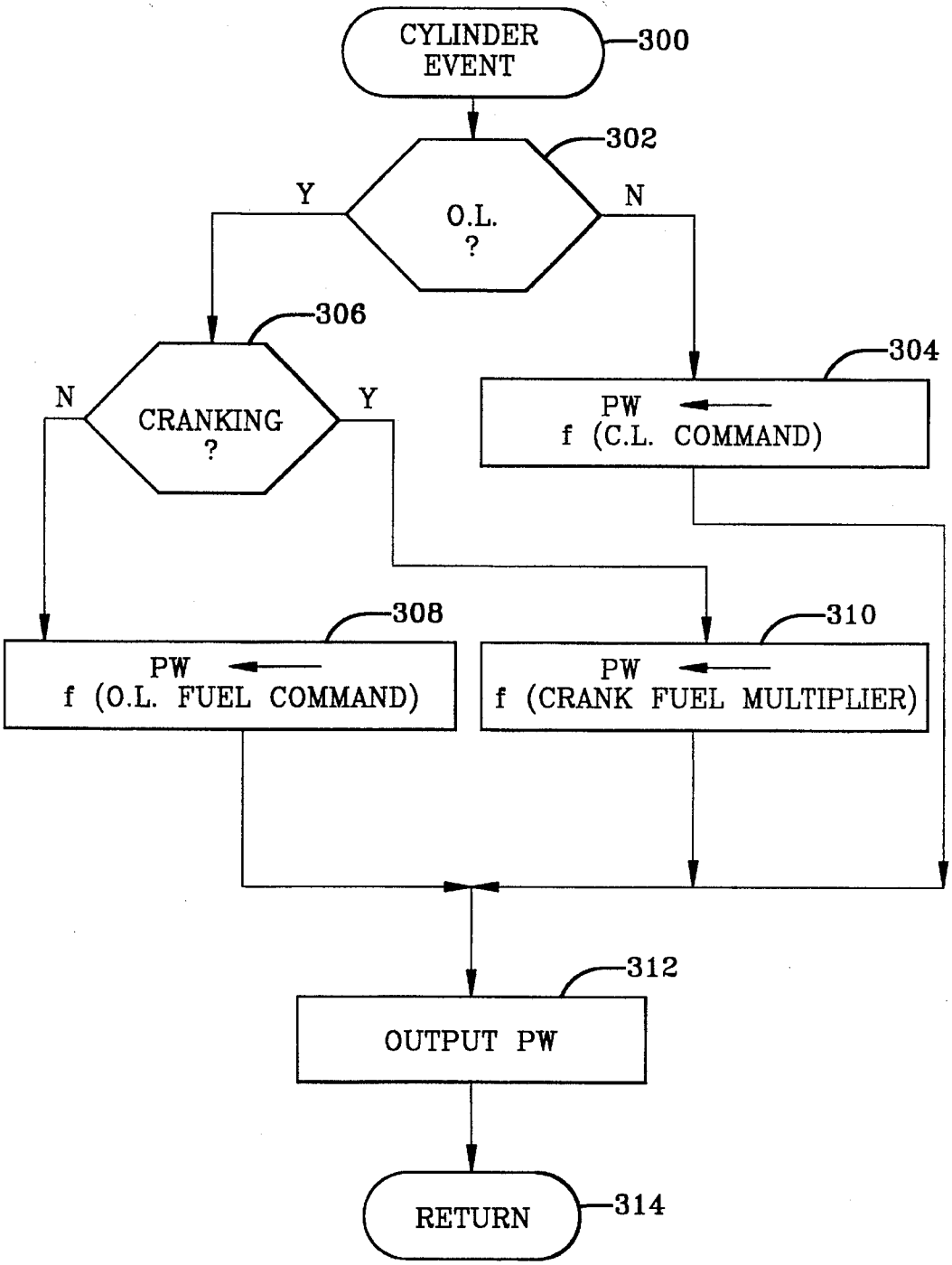

Referring to FIG. 5, a series of operations for servicing, in part, a cylinder event interrupt generated, for example, by passage of a tooth or notch of the engine output shaft 12 by the sensor 16 (FIG. 1). In addition to any operations conventionally carried out following such a cylinder event interrupt to provide for servicing thereof, the operations of steps 302–312 are executed in this embodiment, to illustrate the specific operations required to provide for engine startup fueling control. Specifically, the operations of FIG. 5 are initiated following a cylinder event at a step 300 and then proceed to determine whether open-loop engine control is currently active, as described, at a step 302. If open-loop control is not active, an injector pulse width PW command is next determined as a function of a closed-loop fuel control command as generated through the described conventional closed-loop fuel control operations of the step 214 (FIG. 4). The pulsewidth PW is the injector on-time that will provide for delivery of a commanded fuel quantity to a cylinder intake runner. The command PW is next output at a step 312 to fuel injector drivers 18 for timed application to a next active fuel injector corresponding to an engine cylinder so that injection of the fuel quantity corresponding to PW occurs just prior to an intake valve opening event of the corresponding engine cylinder, as is generally understood in the art.

Returning to the step 302, if open-loop control is active, a determination is made at a next step 306 of whether the engine is currently cranking. If the engine is cranking, a fuel injector command PW is next determined at a step 310 as a function of the crank fuel multiplier stored at the described step 212, for example as a product of a base fuel mass determined as a function of engine coolant temperature TEMP in accord with conventional engine control practices and the crank fuel multiplier CFM. The determined PW command is next output to the drivers 18 (FIG. 1) at the described step 312. If the engine is not currently cranking as determined at the step 306, an injector command PW is next determined at a step 308 as a function of the open-loop fuel command determined at the described step 236 of FIG. 4, such as corresponding to the injector opening time required to deliver the mass of fuel represented by the open-loop fueling command to the cylinder intake runner. The determined command PW is next output to the drivers 18 (FIG. 1) at the described step 312. Following the step 213, the described step 314 is carried out.

The preferred embodiment for the purpose of explaining this invention is not to be taken as limiting or restricting this invention since many modifications may be made through the exercise of ordinary skill in the art without departing from the scope of the invention.

The embodiments of the invention in which a property or privilege is claimed are described as follows:

1. An engine control method for controlling operation of an internal combustion engine during an engine startup period following an engine shutdown period, comprising the steps of:

generating a base engine control command;

determining the time length of the engine shutdown period;

measuring engine shutdown temperature at the beginning of the engine shutdown period;

measuring engine startup temperature at the end of the engine shutdown period;

modeling the temperature of predetermined engine parts as a predetermined function of the measured engine shutdown temperature, the measured engine startup temperature, and the determined time length;

referencing a control command adjustment as a predetermined function of the determined time length and as a predetermined function of the modeled temperature;

applying the control command adjustment to the base engine control command to adjust the base engine control command; and controlling operation of the engine during the startup period in accord with the adjusted base engine control command.

2. An engine control method for controlling operation of an internal combustion engine during an engine startup period following an engine shutdown period, comprising the steps of:

generating a base engine control command;

determining the time length of the engine shutdown period;

generating an adjustment decay value as a predetermined function of the determined time length;

referencing a control command adjustment as a predetermined function of the determined time length;

applying the decay value to the control command adjustment to decrease the control command adjustment toward a zero adjustment;

applying the decreased control command adjustment to the base engine control command to adjust the base engine control command; and controlling operation of the engine during the startup period in accord with the adjusted base engine control command.

3. The method of claim 2, further comprising the steps of:

generating a delay value as a predetermined function of the determined time length of the shutdown period;

delaying the step of applying the decay value during the startup period in accord with the delay value.

4. The method of claim 2, wherein the step of applying the decay value repeatedly applies the decay value to the control command adjustment at a predetermined frequency during the engine startup period to decrease the control command adjustment toward zero.

5. An engine control method for controlling operation of an internal combustion engine during an engine startup period following an engine shutdown period comprising the steps of:

generating a base engine control command;

determining the time length of the engine shutdown period;

sensing an engine shutdown condition at the beginning of the engine shutdown period and at the end of an engine operating period;

measuring a time length of the engine operating period when the engine shutdown condition is sensed;

comparing the measured time length of the engine operating period with a predetermined time length;

sensing a short run operating condition when the measured time length is less than the predetermined time length, referencing a short run compensation value as a control command adjustment when the short run operating condition is sensed;

applying the control command adjustment to the base engine control command to adjust the base engine control command; and controlling operation of the engine during the startup period in accord with the adjusted base engine control command.

6. An engine fuel control method for varying engine fueling rate by varying a fuel delivery amount, wherein engine fueling is provided through timed application of the varied fuel delivery amount to the engine during an engine startup period following an engine shutdown period, the method comprising the steps of:

generating a base fuel delivery amount as a predetermined function of a desired engine air/fuel ratio;

measuring the time length of the engine shutdown period;

sensing a shutdown temperature value indicating engine temperature at the beginning of the shutdown period;

referencing an offset correction factor as a predetermined function of the sensed shutdown temperature and the measured time length of the shutdown period;

referencing a fuel offset as a predetermined function of the measured time length;

correcting the offset by applying the correction factor to the offset;

adjusting the base fuel delivery amount by the corrected offset; and controlling engine fueling in accord with the adjusted base fuel delivery amount.

7. An engine fuel control method for varying engine fueling rate by varying a fuel delivery amount, wherein engine fueling is provide through timed application of the varied fuel delivery amount to the engine during an engine startup period following an engine shutdown period, the method comprising the steps of:

generating a base fuel delivery amount as a predetermined function of a desired engine air/fuel ratio;

measuring the time length of the engine shutdown period;

sensing a predetermined engine short run condition;

sensing a temperature value indicating a current engine temperature condition, referencing a fuel offset, by (a) referencing a fuel offset as a predetermined function of the measured time length when the short run condition is sensed; and (b) referencing the fuel offset as a predetermined function of the sensed temperature value when the short run condition is not sensed;

adjusting the base fuel delivery amount by the referenced fuel offset; and controlling engine fueling in accord with the adjusted base fuel delivery amount.

8. An engine fuel control method for varying engine fueling rate by varying a fuel delivery amount, wherein engine fueling is provided through timed application of the varied fuel delivery amount to the engine during an engine startup period following an engine shutdown period, the method comprising the steps of:

generating a base fuel delivery amount as a predetermined function of a desired engine air/fuel ratio;

measuring the time length of the engine shutdown period;

referencing a fuel offset as a predetermined function of the measured time length;

adjusting the base fuel delivery amount by the referenced fuel offset;

sensing an operating condition in which the engine is cranking;

sensing a presence of a predetermined engine short run condition;

referencing a crank fuel offset as a predetermined function of the measured time length of the shutdown period when the engine is cranking and when the short run condition is sensed;

generating a base crank fuel command;

adjusting the base crank fuel command by the referenced crank fuel offset;

controlling engine fueling in accord with the adjusted base fuel delivery amount; and controlling engine fueling while the engine is cranking in accord with the adjusted base crank fuel command.

* * * * *